US006446530B1

(12) United States Patent
Chang

(10) Patent No.: US 6,446,530 B1
(45) Date of Patent: Sep. 10, 2002

(54) RATCHET WRENCH

(76) Inventor: Jong-Shing Chang, No. 5, Chang Ma Street, Ma Hsing Village, Shiow Shoei Hsian, Chang Hua Hsien (TW)

( * ) Notice: Subject to any disclaimer, the term of this patent is extended or adjusted under 35 U.S.C. 154(b) by 0 days.

(21) Appl. No.: 09/680,510

(22) Filed: Oct. 5, 2000

(51) Int. Cl.[7] ..... B25B 13/46
(52) U.S. Cl. ..... 81/60; 81/63; 81/58
(58) Field of Search ..... 81/60, 58, 63, 81/111

(56) References Cited

U.S. PATENT DOCUMENTS

| | | | | | |
|---|---|---|---|---|---|
| 666,202 | A | * | 1/1901 | Lord | 81/60 |
| 2,264,012 | A | * | 11/1941 | Wasson | 81/60 |
| 3,901,106 | A | * | 8/1975 | Causey | 81/111 |
| 4,308,769 | A | * | 1/1982 | Rantanen | 81/63 |
| 5,636,557 | A | * | 6/1997 | Ma | 81/60 |
| 5,953,966 | A | * | 9/1999 | Spirer | 81/60 |
| 5,964,129 | A | * | 10/1999 | Shiao | 81/60 |
| 5,979,274 | A | * | 11/1999 | Hsieh | 81/60 |

FOREIGN PATENT DOCUMENTS

| | | | | | |
|---|---|---|---|---|---|
| GB | 2 133 332 | A | * | 7/1984 | 81/58 |

* cited by examiner

*Primary Examiner*—James G. Smith
*Assistant Examiner*—Hadi Shakeri
(74) *Attorney, Agent, or Firm*—Browdy and Neimark, P.L.L.C.

(57) ABSTRACT

A ratchet wrench comprises a main body provided with a disposing portion and a receiving cell. A wrenching member is provided with a first toothed portion and is pivoted in the disposing portion of the main body. An arresting member is provided with a second toothed portion and is disposed in the receiving cell such that the second toothed portion is engageable with the first toothed portion. The arresting member and the wrenching member are urged by a first resilient member which serves to provide the arresting member with a spring force enabling the wrenching member to be turned unidirectionally. The arresting member and the wrenching member are further urged by a second resilient member which serves to provide the arresting member with a spring force enabling a greater area of the second toothed portion of the arresting member to be meshed with the first toothed portion of the wrenching member.

10 Claims, 5 Drawing Sheets

RATCHET WRENCH

FIELD OF THE INVENTION

The present invention relates generally to a wrench, and more particularly to a ratchet wrench.

BACKGROUND OF THE INVENTION

A ratchet wrench of the prior art comprises a main body, a ratchet gear, an arresting block, and a spring. When the ratchet gear is turned in a direction, it is arrested by the arresting block. In other words, the arresting block serves to allow the ratchet gear to be turned in only one direction.

When a bolt or nut is about to be turned by the ratchet wrench, only a few teeth of the front end of the arresting block are meshed with the ratchet gear. In order to turn the bolt or nut by the ratchet wrench, the arresting block and the ratchet gear must work together to overcome the resistance force of the bolt or nut. Under such a circumstance as described above, the engaging teeth of the arresting block and the ratchet gear are susceptible to breakdown.

SUMMARY OF THE INVENTION

It is therefore the primary objective of the present invention to provide a ratchet wrench comprising a ratchet gear capable of an intimate engagement with an arresting block of the ratchet wrench.

It is another objective of the present invention to provide a ratchet wrench with a ratchet wheel having durable teeth.

It is still another objective of the present invention to provide a ratchet wrench with means to locate securely the engaging teeth of the arresting block and the ratchet gear.

In keeping with the principle of the present invention, the foregoing objectives of the present invention are attained by the ratchet wrench comprising a main body, a wrenching member, an arresting member, a first resilient member, and a second resilient member. The main body is provided at one end with at least one disposing portion and one receiving cell. The wrenching member is pivoted in the disposing portion of the main body and is provided in the outer side with a toothed portion. The arresting member has a toothed portion engageable with the toothed portion of the wrenching member. The arresting member and the wrenching member are urged by the first resilient member such that the arresting member is provided with a spring force, and that the wrenching member can be turned in only one direction. The arresting member and the wrenching member are further urged by the second resilient member such that the arresting member is provided with a spring force to enable the toothed portion of the arresting member to have a greater engagement area to mesh with the toothed portion of the wrenching member. As a result, the action force is evenly distributed to a greater number of teeth of the two toothed portions, so as to prevent the breakdown of the teeth of the toothed portions.

DETAILED DESCRIPTION OF THE INVENTION

Figure 1:
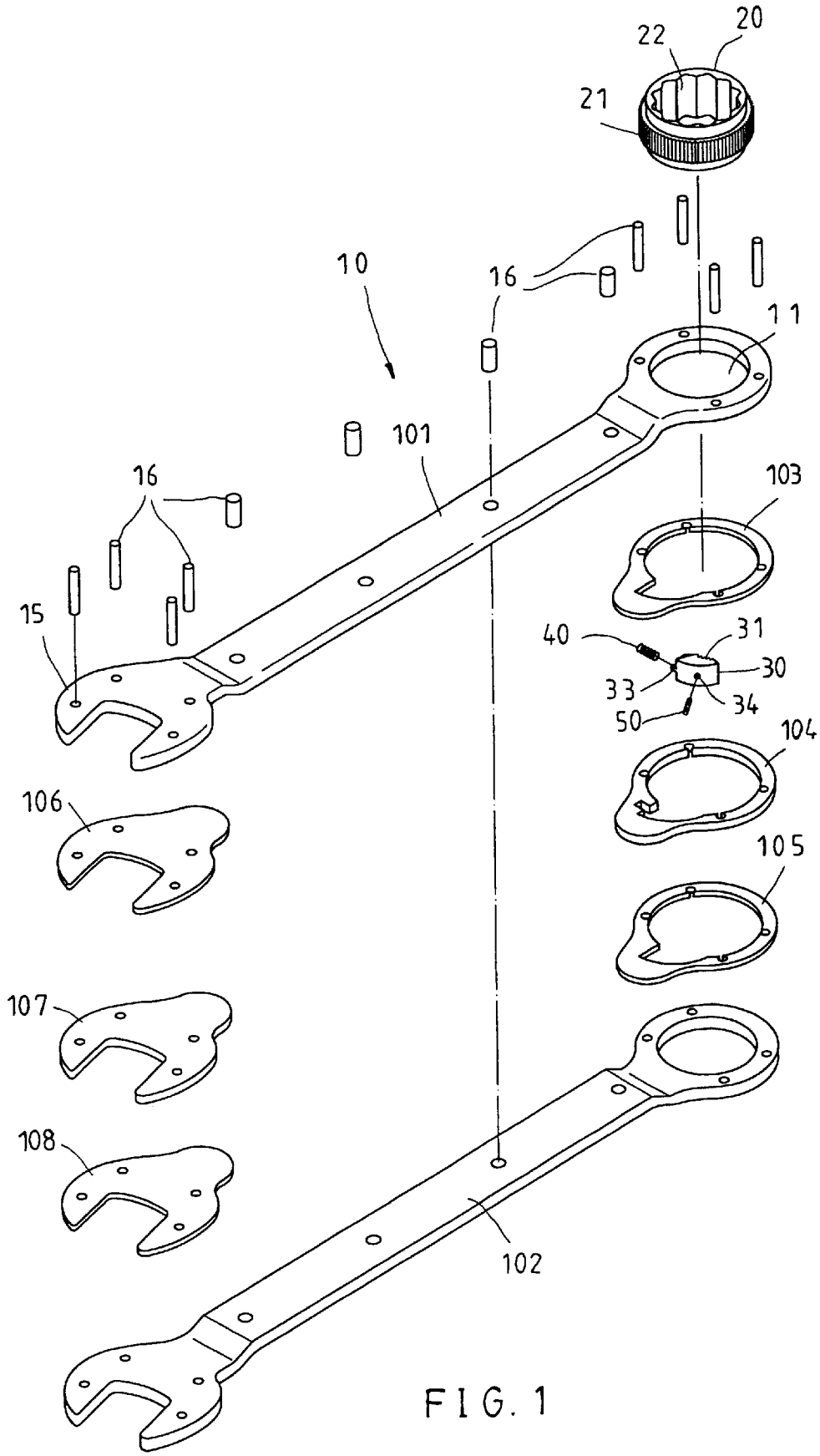
FIG. 1 shows an exploded view of a first preferred embodiment of the present invention.
Figure 2:
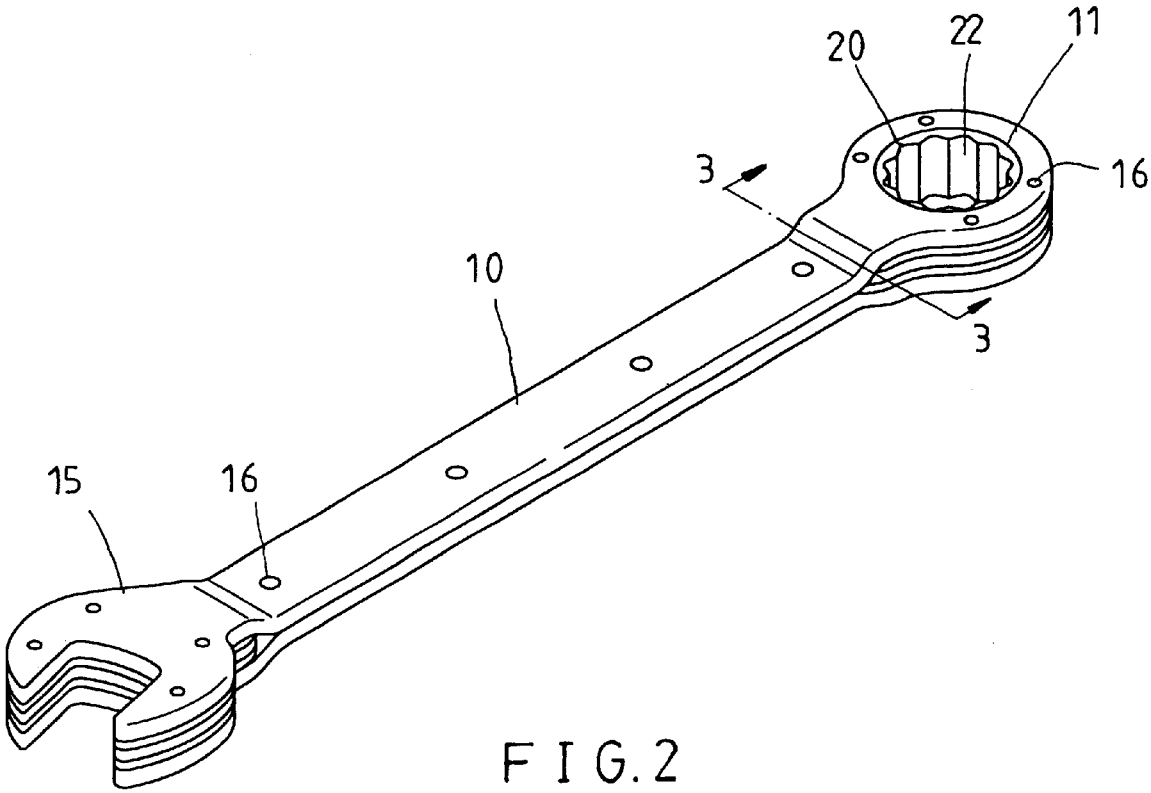
FIG. 2 shows a perspective view of the first preferred embodiment of the present invention in combination.

As shown in FIGS. 1 and 2, a ratchet wrench of the first preferred embodiment of the present invention comprises the component parts, which are described hereinafter.

A main body 10 is provided at one end with a disposing portion 11, which is a through hole, and in the inner side wall with a receiving cell 12 having in one side thereof a recess 13. The main body 10 comprises an upper main body 101, a lower main body 102, and three plate bodies 103, 104 and 105 which are located at the position of the disposing portion 11. The open wrenching portion 15 of another end is provided with three plate bodies 106, 107 and 108. The upper main body 101, the lower main body 102, and all plate bodies 103, 104, 105, 106, 107, and 108 are joined together by a plurality of rivets 16 to form a wrench, as shown in FIG. 2. The features of the present invention are described hereinafter.

A wrenching member 20 is of a columnar construction and is provided in the outer periphery with a toothed portion 21. The wrenching member 20 is provided in the center with a polygonal hole 22 for receiving a bolt or nut. The wrenching member 20 is disposed in the disposing portion 11 of the main body 10. In view of the fact that the hole diameters of the upper main body 101 and the lower main body 102 are smaller than the outer diameter of the wrenching member 20, the wrenching member 20 is prevented from slipping out and is capable of rotating freely.

An arresting member 30 is disposed in the receiving cell 12 of the main body 10 and is provided with a toothed portion 31 opposite in location to and engageable with the toothed portion 21 of the wrenching member 20. The arresting member 30 is further provided with a projection 33 and a round hole 34 opposite in location to the toothed portion 31.

A first resilient member 40 is a spring, which is fitted at one end thereof over the projection 33 of the arresting member 30 and is received at other end thereof in the first recess 13 of the main body 10. The spring 40 serves to provide the arresting member 30 with a spring force enabling the arresting member 30 to move in an opposite direction, so as to cause the wrenching member 20 to turn unidirectionally. The arresting member 30 prevents the wrenching member 20 from turning in reverse direction.

A second resilient member 50 is a spring, which is received at one end thereof in the round hole 34 of the arresting member 30 such that other end of the spring 50 urges the wall of the receiving cell 12 of the main body 10. The expansion directions of the first and the second resilient members 40 and 50 form a predetermined angle, thereby enabling the second resilient member 50 to provide the arresting member 30 with a spring force. When the wrenching member 20 is turned in reverse direction, the toothed portion 31 of the arresting member 30 is meshed in its entirety with the toothed portion 21 of the wrenching member 20.

Figure 3:
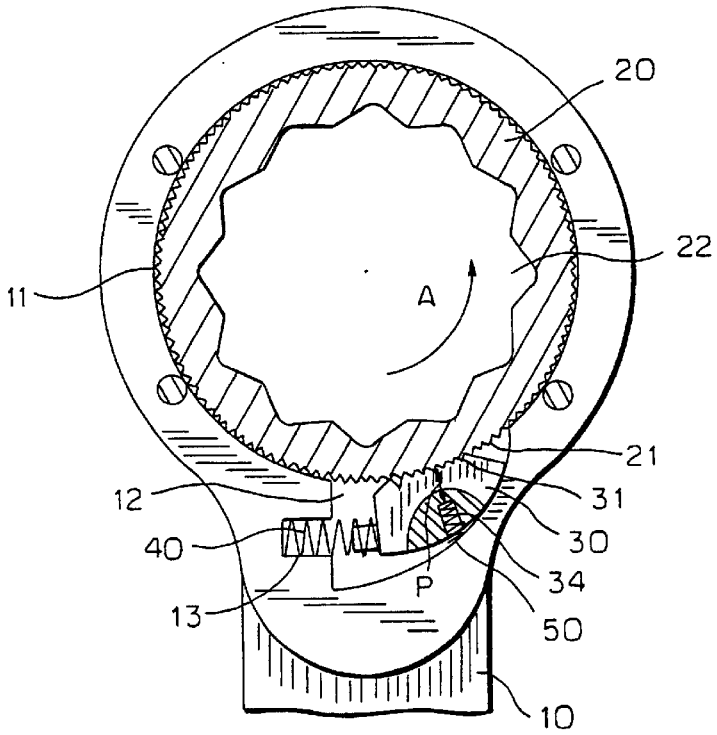
FIG. 3 shows a sectional view taken along the direction indicated by a line 3—3 as shown in FIG. 2.

The present invention is characterized by the second resilient member 50, which has a force P urging the arresting member 30, as shown in FIG. 3. Before the wrenching member 20 is turned, the force P of the second resilient member 50 keeps the toothed portion 31 of the arresting member 30 to be meshed with the toothed portion 21 of the wrenching member 20. As a result, when the ratchet wrench of the present invention is used to turn a bolt or nut in a direction as indicated by an arrow A in FIG. 3, the resistance force is evenly distributed to the teeth of the two toothed portions 21 and 31, which are therefore less susceptible to breakdown. In addition, the ratchet wrench of the present invention is thus provided with a greater torsion force to work on the bolt or nut.

Figure 4:
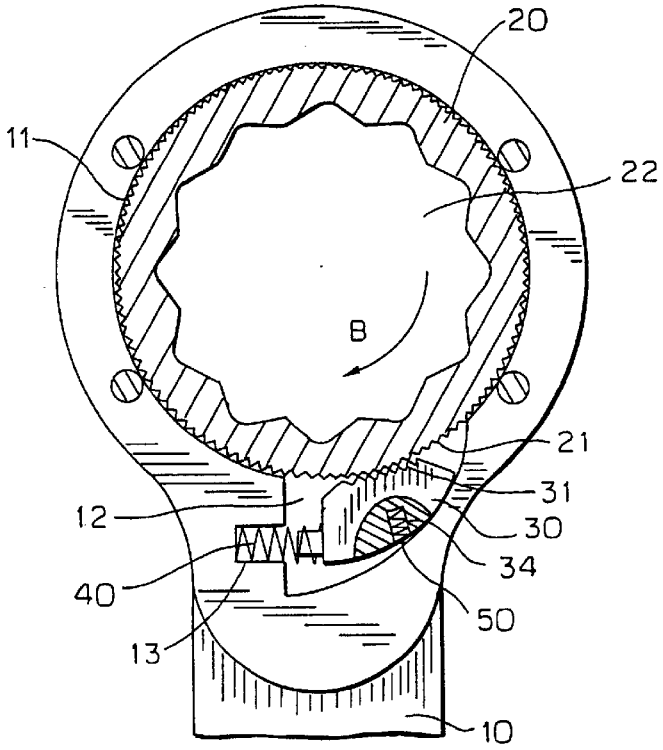
FIG. 4 shows an action schematic view of FIG. 3.

When the ratchet wrench of the present invention is turned in reverse, as indicated by an arrow B in FIG. 4, the toothed portion 31 of the arresting member 30 is urged by the toothed portion 21 of the wrenching member 20, thereby overcoming the spring forces of the two resilient members 40 and 50. The arresting member 30 is thus slightly withdrawn, whereas the main body 10 is idled.

Figure 5:
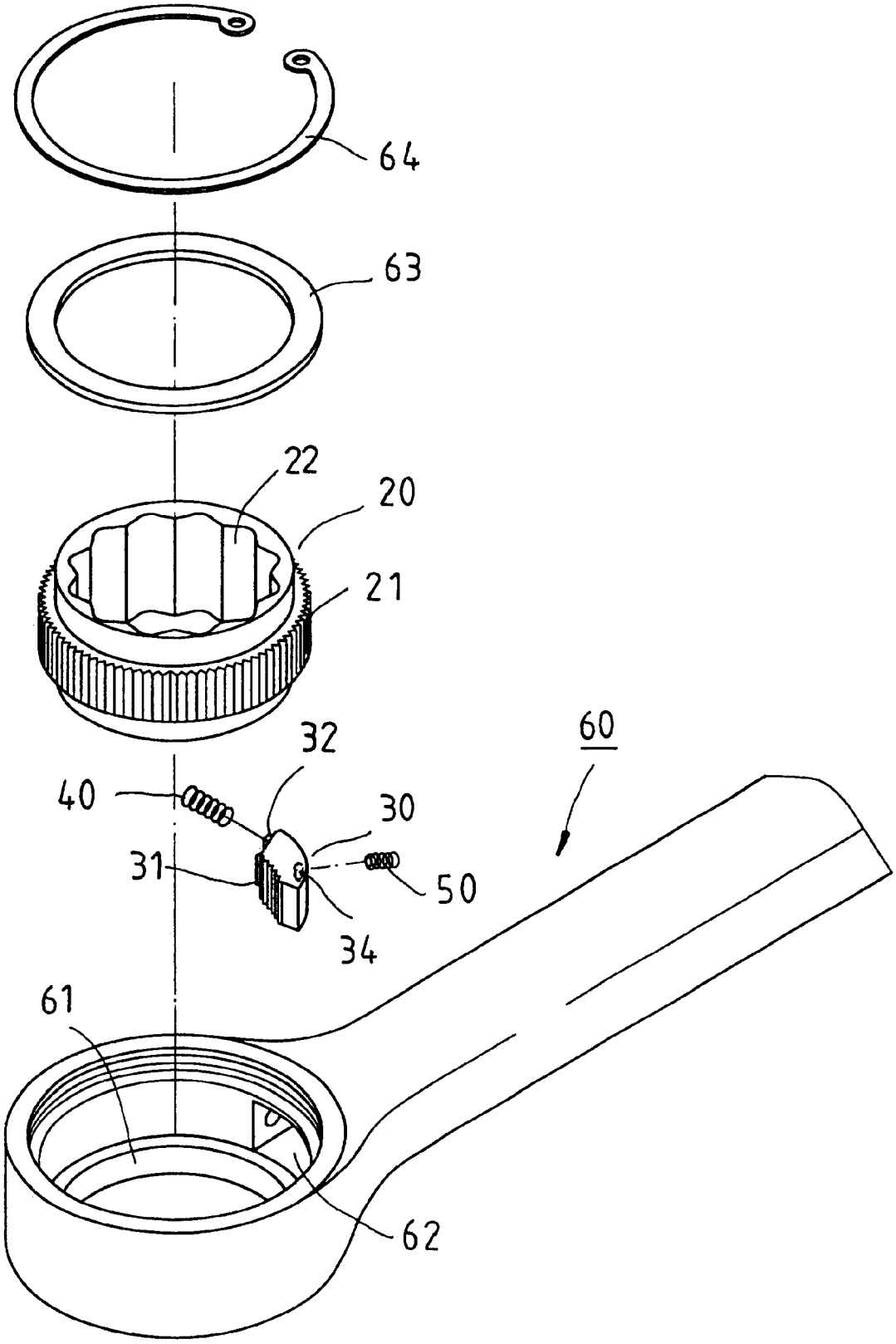
FIG. 5 shows an exploded view of a second preferred embodiment of the present invention.
Figure 6:
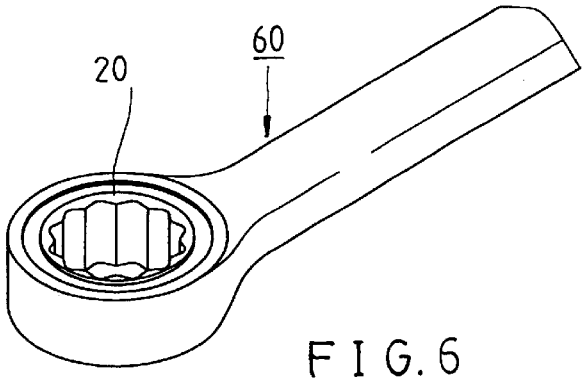
FIG. 6 shows a perspective view of the second preferred embodiment of the present invention in combination.

As shown in FIGS. 5 and 6, the main body of the present invention may be integrally made by forging such that the main body 60 is provided with a disposing portion 61 and a receiving cell 62 for accommodating respectively the wrenching member 20 and the arresting member 30 in conjunction with a sealing member 63 and a retaining ring 64.

Figure 7:
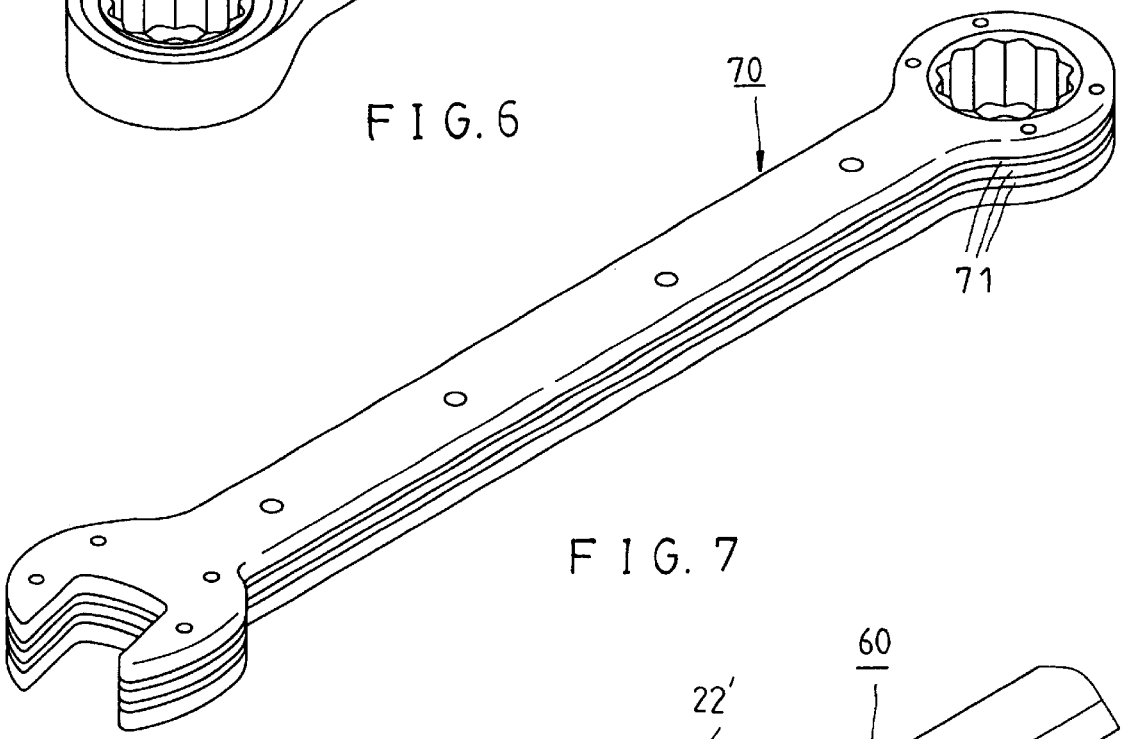
FIG. 7 shows a perspective view of a third preferred embodiment of the present invention in combination.

As shown in FIG. 7, a ratchet wrench.70 of the present invention is formed of a plurality of plate bodies 71, with each having a wrench shape.

Figure 8:
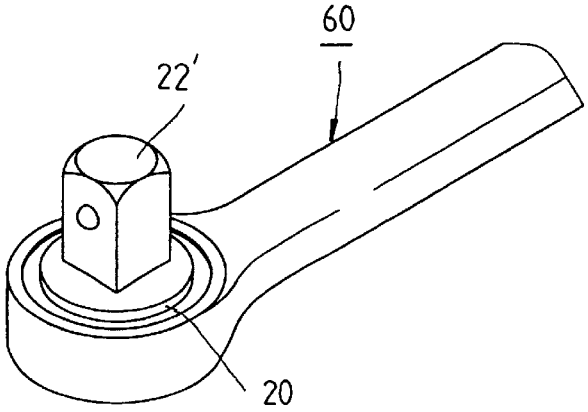
FIG. 8 shows a perspective view of a fourth preferred embodiment of the present invention in combination.

The wrenching member 20 of the present invention may be devoid of the polygonal hole 22 and provided at one end with a connection pillar 22' for connecting a socket, as shown in FIG. 8.

The first and the second resilient members 40 and 50 may be coil springs, spring pieces, or acrylic rubber blocks, which are effective in providing the toothed portion 31 of the arresting member 30 with the force P to press against the toothed portion 21 of the wrenching member 20.

Figure 9:
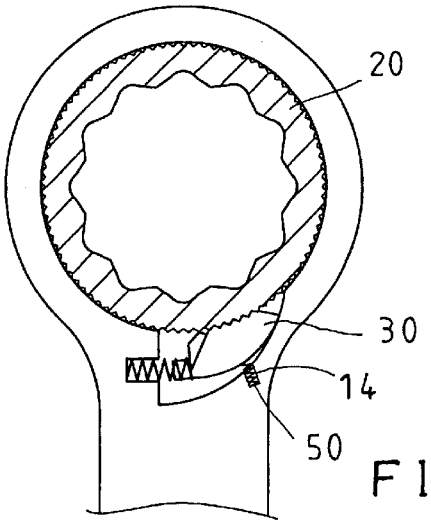
FIG. 9 shows a partial perspective view of a fifth preferred embodiment of the present invention in combination.

One end of the second resilient member 50 may be disposed in a second recess 14 of the main body 10 or in a position corresponding to the arresting member 30, whereas other end of the second resilient member 50 urges the side edge of the arresting member 30, as shown in FIG. 9. As a result, the second resilient member 50 is equally effective in providing the toothed portion 31 of the arresting member 30 with the force P to press against the toothed portion 21 of the wrenching member 20.

What is claimed is:

1. A ratchet wrench comprising:

a main body provided at one end with a disposing portion having a receiving cell;

a wrenching member provided with a toothed portion and rotatable in said disposing portion of said main body;

an arresting member provided with a toothed portion and disposed in said receiving cell of said main body such that said toothed portion of said arresting member is engageable with said toothed portion of said wrenching member; and a first resilient member urging at a first end thereof said arresting member and at a second end thereof said main body for providing said arresting member with a spring force enabling said ratchet wrench to rotate around the wrenching member in a first direction when engaged to a fastened nut or bolt;

wherein said arresting member is further urged by a first end of a second resilient member, with a second end of said second resilient member urging said main body, said second resilient member serving to provide said arresting member with a spring force to enhance the engagement of said toothed portion of said arresting member with said toothed portion of said wrenching member so that said wrenching member when engaged to a fastened nut or bolt rotates with said ratchet wrench in a second direction opposite to the first direction;

wherein expansion directions of the first resilient member and the second resilient member form a predetermined angle which respectively enable the rotation of the ratchet wrench in the first direction around the wrenching member and the second direction with the wrenching member, and wherein the expansion direction of the first resilient member substantially parallels then a tangential direction of the wrenching member, and the expansion direction of the second resilient member and the said tangential direction of the wrenching member are substantially normal.

2. The ratchet wrench as defined in claim 1, wherein said receiving cell of said main body is provided with a recess; wherein said second end of said second resilient member urges a bottom wall of said recess.

3. The ratchet wrench as defined in claim 1, wherein said arresting member is provided with a recess; wherein said first end of said second resilient member urges a bottom wall of said recess.

4. The ratchet wrench as defined in claim 1, wherein said arresting member is provided with a projection; wherein said first resilient member is fitted at said first end thereof over said projection of said arresting member.

5. The ratchet wrench as defined in claim 4, wherein said receiving cell of said main body is provided with a recess; wherein said first resilient member urges at the second end thereof bottom of said recess of said receiving cell.

6. The ratchet wrench as defined in claim 1, wherein said wrenching member is provided with polygonal hole.

7. The ratchet wrench as defined in claim 1, wherein said wrenching member is provided with at least one connection pillar for connecting a socket.

8. The ratchet wrench as defined in claim 1, wherein said first resilient member is a coil spring, spring piece, or acrylic rubber block.

9. The ratchet wrench as defined in claim 1, wherein said second resilient member is a coil spring, spring piece, or acrylic rubber block.

10. The ratchet wrench as defined in claim 1, wherein the predetermined angle is less than 90°.

* * * * *